United States Patent [19]

Yoneeyama

[11] Patent Number: 4,919,438

[45] Date of Patent: Apr. 24, 1990

[54] TENNIS RACKET

[75] Inventor: Minoru Yoneeyama, Niigata, Japan

[73] Assignee: Yonex Kabushiki Kaisha, Niigata, Japan

[21] Appl. No.: 204,876

[22] Filed: Jun. 10, 1988

[30] Foreign Application Priority Data

Jan. 23, 1988 [JP] Japan ..... 63-6647

[51] Int. Cl.[5] ..... A63B 49/02

[52] U.S. Cl. ..... 273/73 C; 273/73 G

[58] Field of Search ..... 273/73 R, 73 C, 73 D, 273/73 F, 73 G, 73 J

[56] References Cited

U.S. PATENT DOCUMENTS

| | | | |
|---|---|---|---|
| 3,647,211 | 3/1972 | Doessel | 273/73 C |
| 3,809,402 | 5/1974 | Haines | 273/73 C |
| 4,177,990 | 12/1979 | Kajiwara | 273/73 C |
| 4,565,371 | 1/1986 | Pawlicki | 273/73 C |
| 4,664,380 | 5/1987 | Keubler | 273/73 C |

*Primary Examiner*—Edward M. Coven
*Assistant Examiner*—William E. Stoll
*Attorney, Agent, or Firm*—Emrich & Dithmar

[57] ABSTRACT

In a tennis racket having a frame portion and a shaft portion formed integrally with the frame portion of a fiber-reinforced plastic, the shaft portion has in a direction perpendicular to a striking area a minimum thickness (T2) at a longitudinally intermediate part thereof, the minimum thickness (T2) being between 60% and 80% of the thickness (T1) at the lower end of the shaft portion, while the frame portion has in the same direction a maximum thickness (T3) at the side portions thereof corresponding to a striking sweet spot and a minimum thickness (T4) at the top thereof, the maximum thickness (T3) being between 110% and 140% of the thickness (T1) and being between 135% and 160% of the minimum thickness (T4), whereby a time elapsed until the shaft portion reaches an initial maximum amplitude value when vibrating in the ball striking direction at an impact of a ball is approximated to a time elapsed until the side portions of the frame portion reach an initial maximum amplitude value when vibrating toward the center of the striking area at the impact.

4 Claims, 3 Drawing Sheets

TENNIS RACKET

BACKGROUND OF THE INVENTION

1. Field of the Invention

The present invention relates to a tennis racket and more particularly to a tennis racket having a frame portion, a shaft portion, the frame and shaft portions being integrally formed of a fiber-reinforced synthetic resin, a grip portion contiguous to the lower end of the shaft portion, and a throat portion provided at the inside lower end of the frame portion to define a ball striking area.

2. Description of the Prior Art

Recently, FRP tennis rackets having frame and shaft portions integrally formed of a fiber-reinforced synthetic resin have been becoming predominant in the market in place of wooden or aluminum rackets. In designing the tennis racket of this type, a so-called "pliancy" of the shaft portion at the time of striking a ball is an important factor as in the rackets of other materials. Various manufacturers now market several kinds of tennis rackets which are different in pliancy depending on the level of player.

Heretofore, the pliancy of the racket has been studied mainly in connection with the ball striking direction. That is, when a player strikes a ball while gripping the grip portion, the shaft portion deflects in a direction opposite to a ball shooting direction due to impact of the ball on strings which are stretched over the striking area, and at the next instant it deflects in the reverse direction. The ball return speed is increased by utilizing this vibration. On the other hand, recent researches have revealed that rackets, especially FRP rackets, vibrate at the time of impact not only in the aforesaid ball striking direction but also, at both side portions of the frame, in a direction toward and away from a center of the striking area. More particularly, with expansion of the strings at the time of impact, both side portions of the frame to which both ends of the shorter lateral strings are fastened deflect toward the center to approach each other, causing another vibration different from the vibration in the ball striking direction.

Such vibration at both side portions of the frame has heretofore been almost ignored, because it is rather small as compared with the vibration in the ball striking direction. However, as a result of earnest researches, the present inventor has found that a correlation between these two vibrations exerts an important influence on the performance of a racket. Experiments conducted by the inventor has shown that, in conventional rackets, the time elapsed until reaching an initial maximum amplitude value in the vibration in the ball striking direction is different not less than 15% from the time elapsed until reaching an initial maximum amplitude value in the vibration at both side portions of the frame. Consequently, the two vibrations interfere with each other to offset the energy transmitted to the ball.

The present invention has been accomplished on the basis of the above knowledge, and its object is to provide a tennis racket capable of correlating the vibration in the ball striking direction of the shaft portion and the vibration toward and away from the center of the striking area at both side portions of the frame with each other in an optimum manner, thereby permitting efficient transfer of energy to a ball.

SUMMARY OF THE INVENTION

According to the present invention, a tennis racket comprises a frame portion, a shaft portion, the frame and shaft portions being integrally formed of a fiber-reinforced synthetic resin, a grip portion contiguous to the lower end of the shaft portion, and a throat portion provided at the inside lower end of the frame portion to define a ball striking area. The shaft portion has in a direction perpendicular to the striking area a minimum thickness (T2) at a longitudinally intermediate part thereof, and this minimum thickness (T2) is between 60% and 80% of the thickness (T1) at the lower end of said shaft portion. The frame portion has in the same direction a maximum thickness (T3) at the side portions thereof corresponding to a striking sweet spot and a minimum thickness (T4) at the top thereof, the maximum thickness (T3) being between 110% and 140% of the thickness (T1) and being between 135% and 160% of the minimum thickness (T4). A time elapsed until the shaft portion reaches an initial maximum amplitude value when vibrating in the ball striking direction at an impact of a ball is approximated to a time elapsed until the side portions of the frame portion reach an initial maximum amplitude value when vibrating toward the center of the striking area at the impact.

Preferably, the time elapsed until the shaft portion reaches the maximum amplitude value is between 90% and 110% of the time elapsed until the frame portion reaches the maximum amplitude value.

According to another aspect of the invention, in a tennis racket of the type set forth above, the thickness of the frame portion and the shaft portion in a direction perpendicular to the striking area is set so as to decrease gradually from the lower end of the shaft portion to a longitudinally intermediate part thereof, then gradually increase from the intermediate part to the side portions of the frame portion in the vicinity of longitudinal center thereof and then decrease gradually from the side portion to the top of the frame portion, whereby a time elapsed until the shaft portion reaches an initial maximum amplitude value when vibrating in the ball striking direction at an impact of a ball is in the range of 90% to 110% of a time elapsed until the side portions of the frame portion reach a maximum amplitude value when vibrating toward the center of the striking area at the impact.

The vibration of the shaft portion in the ball striking direction and the vibration of the side portions of the frame toward the center of the striking area, are closely related to the thickness of the racket in the direction perpendicular to the striking area. In the present invention, the thickness is set as mentioned above to approximate the timing at which the shaft portion reaches the initial maximum amplitude value at the impact to the timing of the frame side portions. Consequently, during a period in which the ball stays on the strings after the maximum amplitude values, both a repulsive force of the shaft portion returning in the ball shooting direction and a repulsive force of the strings increased by a return movement of the frame side portions to their normal positions, are transmitted to the ball synergistically.

Other objects, features and advantages of the invention will become apparent from the following description of preferred embodiments thereof when taken in conjunction with the drawings.

DESCRIPTION OF PREFERRED EMBODIMENTS

Figure 1:
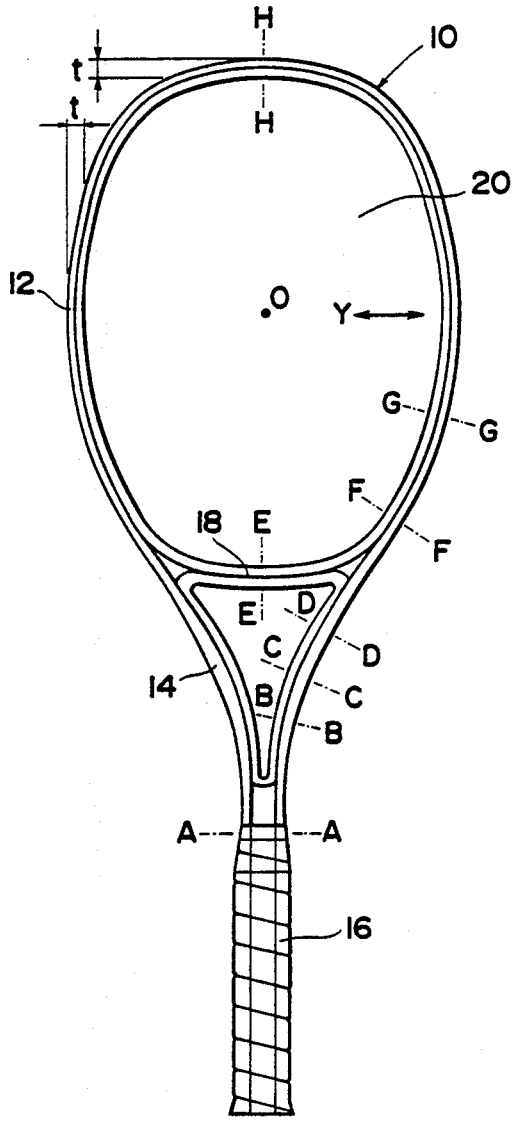
FIG. 1 is a front elevational view showing a tennis racket according to an embodiment of the present invention.

Referring first to FIG. 1 of the drawings, a tennis racket according to an embodiment of the invention is generally indicated by the numeral 10. The racket 10 includes a frame portion 12 and a shaft portion 14 comprising a pair of branches extending downward from the lower ends of both sides of the frame portion 12 to converge at its lower portion, with a grip portion 16 being contiguous to the lower end of the converged shaft portion. The frame portion 12 and the shaft portion 14 are integrally formed by coating a core of an expandable resin material such as urethane foam with layers of resin-impregnated reinforcing fibers. As the reinforcing fibers there may be used various fibers, such as glass fibers, carbon fibers and aromatic polyamide fibers, alone or in a suitable combination. In the illustrated embodiment, glass fibers and carbon fibers are employed to constitute multiple layers. Provided at the inside lower end of the frame portion 12 is a throat portion 18 which is integral with the frame portion 12 and the shaft portions 14 and defines a ball striking area 20. Strings (not shown) are to be stretched over the ball striking area 20 both in the longitudinal direction of the racket and in the direction orthogonal thereto. Further, a groove 22 is formed along the outer peripheral surface of the frame portion 12 and a number of holes 24 for the strings are formed in the groove 22, extending through the frame portion 12. The above construction is substantially the same as in the conventional FRP rackets.

Figure 2:
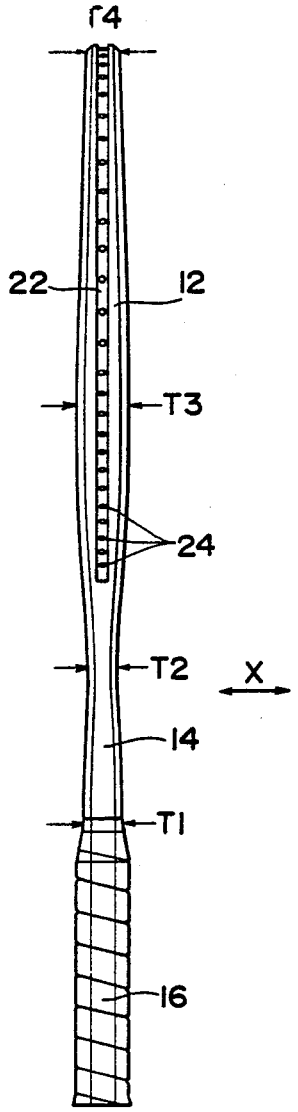
FIG. 2 is a side view thereof.
Figure 3:
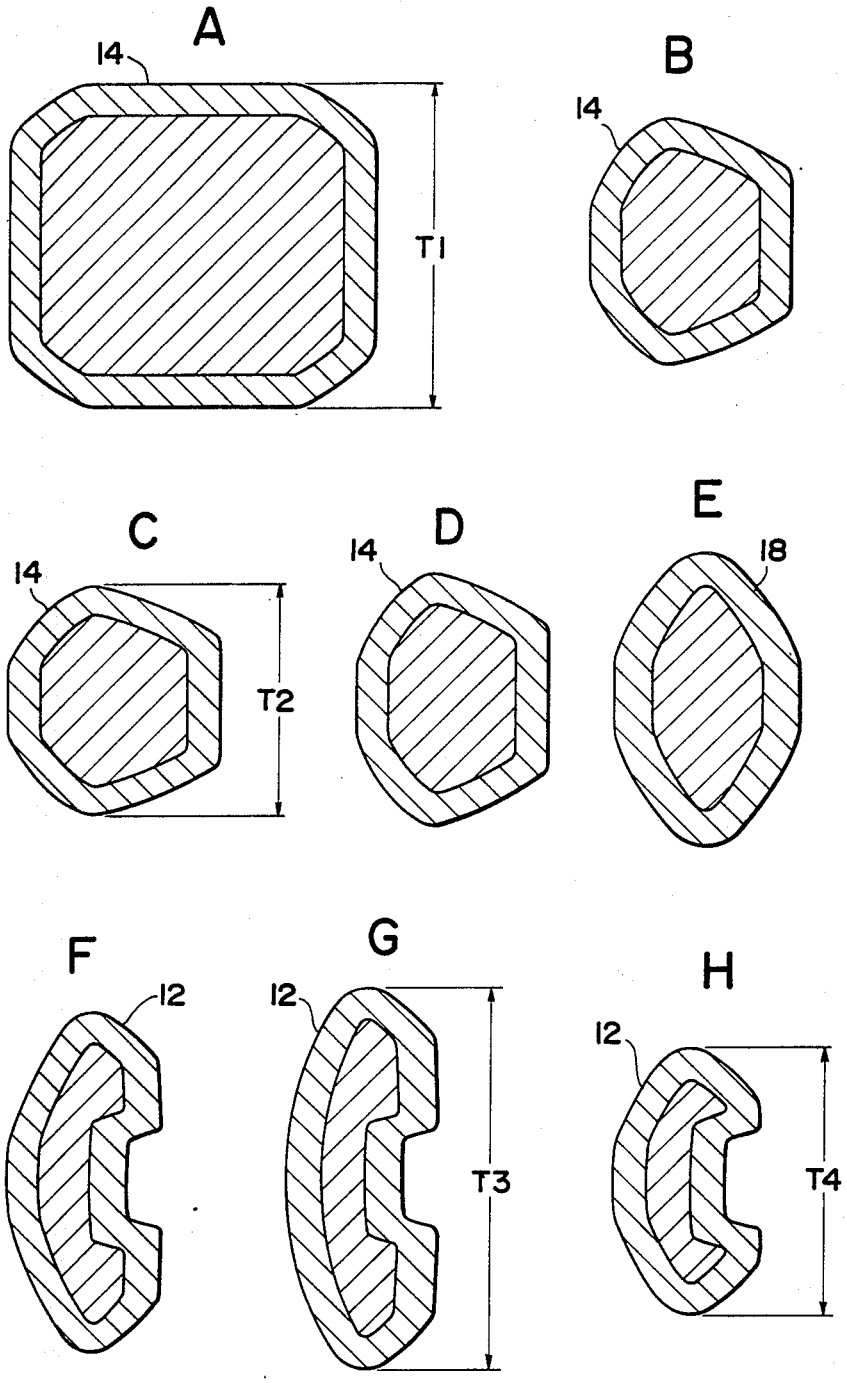
FIGS. 3A to H are end sectional views taken on lines A—A to H—H in FIG. 1.

A fundamental feature of the invention is to approximate the timing at which the shaft portion 14 reaches an initial maximum amplitude value when it vibrates in a ball striking direction (the direction indicated by arrow X in FIG. 2) at impact, to the timing at which the side portions of frame 12 reach an initial maximum amplitude value when they vibrate in the direction of the center 0 of the striking area 20 (in the direction indicated by arrow Y in FIG. 1). The inventor recognized the fact that both of these two vibrations are closely related to the thickness of the shaft portion 14 and that of the frame portion 12 in the direction perpendicular to the striking area 20, and has completed the present invention by changing the thicknesses in a continuous manner.

In order to approximate the above vibration timings each other, thickness of the shaft portion 14 is decreased gradually from a thickness T1 at the lower end to the intermediate part where it has a minimum thickness T2, and then increased gradually to the upper end where it is joined with the frame portion 12. On the other hand, the thickness of the frame portion 12 is gradually increased from the lower ends thereof contiguous to the shaft portion 14 up to portions around the longitudinal center of the frame 12 so that a maximum thickness T3 may be obtained at side portions thereof corresponding to a striking sweet spot or a center of percussion of the area 20. The frame thickness is then decreased gradually toward the top where the thickness is minimized as indicated by T4.

In the illustrated embodiment, the shaft portion 14 has the thickness T1 at its lower part as indicated by line A—A in FIG. 1, the thickness T1 being 25mm. The shaft thickness gradually decreases through the B—B part measured 252 mm away from the grip upper end, and becomes minimum at the C—C part which is 282 mm away from the grip end. The B—B part has the thickness of 19.5 mm and the minimum thickness T2 at C—C part is 18 mm. Thus, a ratio of thickness T2/T1 is 72%. The shaft thickness then turns into increase from the C—C part and it increases through D—D part up to the junction with the frame portion 12, the thickness of the D—D part measured 312 mm above the grip end being 19.6 mm.

The thickness increase continues in the frame portion 12 through the F—F part up to the G—G part. The F—F part is about 297 mm away from the frame top and has the thickness of 27 mm, while the G—G part is about 231 mm below the top with 30 mm thickness. The location of G—G part generally is around the longitudinal center of the frame 12 and, more specifically, is on the frame side portion corresponding to a striking sweet spot or a center of percussion which is positioned slightly below a geometric center 0 of the striking face 20. The frame 12 has the maximum thickness T3 at this G—G part and its measured value is 30 mm, resulting in a ratio T3/T1 being 120%. In the section from G—G part to H—H part which is the top end, the frame thickness gradually decreases and becomes minimum at the H—H top end. The frame minimum thickness T4 is 21 mm, and thus a ratio of the above maximum thickness to the minimum thickness, i.e. T3/T4, is about 143%. Consequently, the thickness of the racket 10 is minimum at the intermediate C—C part of the shaft portion 14 and maximum at G—G part around the longitudinal center of the frame portion 12, with a ratio T2/T3 being 60%.

Meanwhile, the throat portion 18 has the thickness 23.2 mm measured at its center, E—E part.

In the present invention, in order to approximate the timings in vibration of the shaft portion 14 in the X direction and in vibration of the frame side portion in the Y direction each other substantially more closely than in the conventional rackets, it is necessary to set the ratio of the minimum thickness T2 of the shaft portion 14 to the lower end thickness thereof T1, i.e. T2/T1, to a value smaller than 80%, the ratio of the maximum thickness T3 of the frame portion 12 to the above thickness T1, i.e. T3/T1, to a value larger than 110%, and the ratio of the T3 to the minimum frame thickness T4, i.e. T3/T4, to a value larger than 135%. On the other hand, if a T2/T1 ratio would be set lower than 60%, it would result in deficient strength of the shaft portion 14 with causing problem in point of durability. Also, a T3/T1 ratio exceeding 140% would involve too large thickness in the vicinity of the longitudinal center of the frame, thus making it difficult to handle the racket at the time of hitting a ball. Further, if a T3/T4 ratio would exceed 160%, strength of the frame top would be deteriorated to permit easy breakage of the frame. Therefore, it is necessary that the T2/T1, T3/T1 and T3/T4 ratios be in the ranges of 60% to 80%, 110% to 140%, and 135% to 160%, respectively.

The thickness (t) in the direction parallel to the striking area 20 is almost constant throughout the entire circumference of the frame portion 12, while the shaft portion 14 becomes a little wider from the lower branch point toward the middle portions and then narrower to the upper end thereof.

The present inventor manufactured the racket just described above and illustrated in the drawings, and conducted experiments for measuring the vibrations in the X direction of the shaft portion 14 and in the Y direction of the frame side portion, as in the following manner. First, strings formed of nylon were stretched over the ball striking area 20 at a tension of 60 pounds, and sensors adapted to detect vibration were attached to the inner surface (on the side of the striking area 20) of one side portion of the frame 12 at the longitudinal center thereof and also to the front surface (in elevational view) of the shaft portions 14 at around a longitudinal center thereof. These sensors were connected to a dynamic strain measuring apparatus to obtain wave forms of each vibration. The racket was then fixed at the grip portion 16 in such a manner that the shaft portion 14 and the frame portion 12 were positioned in the vertical direction. Thereafter, a ball was shot toward the center 0 of the striking area 20 perpendicularly thereto from a ball shooting machine set at a distance of 1.5 m, and the aforesaid vibrations induced by collision of the ball with the strings were measured. This measurement was repeated while changing the ball speed between 110 km/h and 120 km/h.

Figure 4:
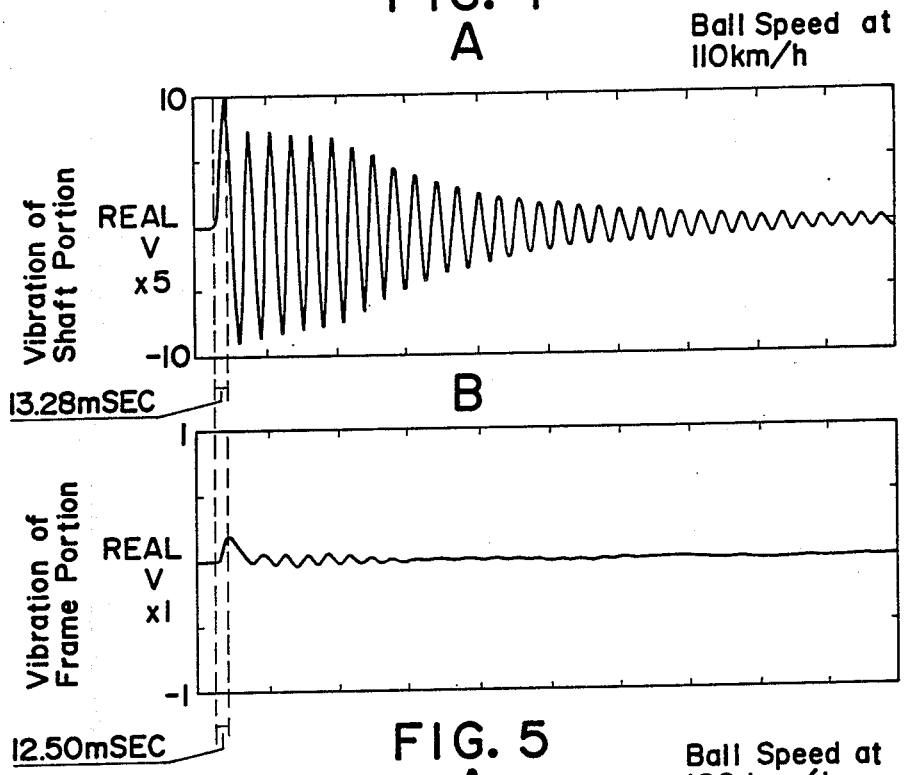
FIGS. 4A, 4B and 5A, 5B are graphs showing test results obtained using the tennis racket of the invention.
Figure 5:
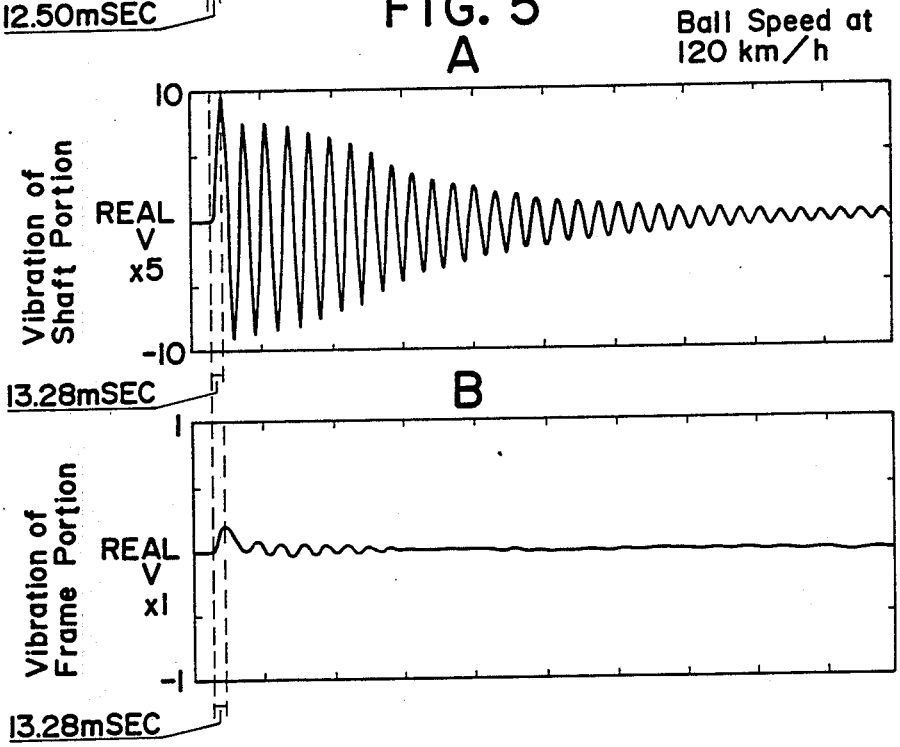

As a result, there were obtained the wave forms shown in FIG. 4 at the ball speed of 110 km/h and the wave forms shown in FIG. 5 at 120 km/h. In each of these FIGURES, A illustrates vibrations of the shaft portion 14 in the ball striking direction (X) recorded in accordance with signals from the sensor attacvhed thereto, while B illustrates vibrations of the frame side portion in the direction (Y) toward and away from the center 0 of the striking area 20 and recorded in accordance with signals from the sensor attached to the frame 12. As indicated in FIG. 4A, the time elapsed until the shaft portion 14 reached an initial maximum amplitude value after the start of vibration was 13.28 milliseconds, while in FIG. 4B the time elapsed until the frame side portion reached an initial maximum amplitude value was 12.50 milliseconds as measured from the same time point as in FIG. 4A. The difference therebetween was only 0.78 milliseconds, which means that the former elapsed time is about 106% of the latter. In other words, the difference is about 6%. Further, in the case where the ball speed was set at 120 km/h, there was observed a surprising effect that both elapsed times were completely coincident with each other, as shown in FIG. 5. It is to be noted here that the time point at which the shaft portion starts vibration substantially agrees with the moment of collision of a ball with the strings.

After reaching the above maximum amplitude values, the shaft and frame portions reverse the direction of their vibrations. That is, the shaft portion deflects toward the ball shooting direction while both side portions of the frame revert to the normal positions, i.e. in directions away from each other, and on the way the ball leaves the strings and starts flying. Therefore, due to the fact that the timings at which both vibrations reach initial maximum amplitudes are very close to each other as mentioned above, during the subsequent ball shooting stage the pliancy (repulsive force) of the shaft portion and the repulsive force of the strings increased by the return of both frame side portions act on the ball synergistically. Consequently, larger energy is transmitted to the ball.

For comparison with the racket described above, another test was conducted in the same manner as above to measure vibrations of a conventional tennis racket whose thickness in the direction perpendicular to the striking area is substantially constant throughout the entirety of the shaft and frame portions. The comparative racket was selected to have substantially the same shape in elevational view as the racket of the above embodiment except that the width of the shaft portion is almost constant. The test resulted in that, at a ball speed of 120 km/h, the time elapsed until reaching an initial maximum amplitude value of the shaft portion after the start of vibration thereof was 17.97 milliseconds, while the time elapsed until reaching an initial maximum amplitude value of the frame side portion measured from the start of vibration of the shaft portion was 21.87 milliseconds. Thus, there was a timing discrepancy as large as 3.90 milliseconds between the two vibrations. This discrepancy corresponds to about 18% of the vibration timing of the frame side portion. This means that in this comparative example, even when the shaft portions begin to repulse in the ball shooting direction, the frame side portions will continue to deflect for a little more while toward the center of the striking area, namely, in the direction in which the repulsive force of the strings is weakened. As a result, both vibrations interfere with each other to weaken the repulsive force of the entire racket. In case the timing discrepancy is reverse, that is, in case where the frame side portions reach the maximum amplitude value prior to the shaft portion reaching the maximum value, there will also occur the loss of repulsive energy due to interference of vibrations.

As described hereinabove, according to the invention the timing at which the shaft portion reaches an initial maximum amplitude value when vibrating in the ball striking direction is approximated to the timing at which both side portions of the frame reach an initial maximum amplitude value when vibrating toward the center of the striking area. Therefore, the repulsive force of the entire racket can be transmitted to a ball efficiently and hence it is possible to increase the ball return speed.

What is claimed is:

1. A tennis racket comprising a frame portion, a shaft portion having an upper end and a lower end, said frame and shaft portions being integrally formed of a fiber-reinforced synthetic resin, a grip portion contiguous to the lower end of said shaft portion, and a throat portion provided at the inside lower end of said frame portion to define a ball striking area, wherein said shaft portion has in a direction perpendicular to said striking area a minimum thickness (T2) at a part thereof longitudinally intermediate its upper and lower ends, said minimum thickness (T2) being about 72% of the thickness (T1) at said lower end of said shaft portion, and said frame portion has in said direction a maximum thickness (T3) at side portions thereof which are located on opposite sides of a striking sweet spot at the same distance from said upper end of said shaft portion and a minimum thickness (T4) at the top thereof, said maximum thickness (T3) being about 120% of said thickness (T1) and being about 143% of said minimum thickness (T4), whereby a time elapsed until said shaft portion reaches an initial maximum amplitude value when vibrating in the ball striking direction at an impact of a ball is in the range of 90% to 110% of a time elapsed until said side portions of said frame portion reach an initial maximum amplitude value when vibrating toward the center of said striking area at the impact.

2. A tennis racket as claimed in claim 1, wherein the thickness (t) of said frame portion in a direction parallel to said striking area is substantially constant throughout the whole circumference thereof.

3. A tennis racket comprising a frame portion, a shaft portion having an upper end and a lower end, said frame and shaft portions being integrally formed of a fiber-reinforced synthetic resin, a grip portion contiguous to the lower end of said shaft portion, and a throat portion provided at the inside lower end of said frame portion has in a direction perpendicular to said striking area a minimum thickness (T2) at a part thereof longitudinally intermediate its upper and lower ends, said minimum thickness (T2) being about 18mm and the thickness (T1) at said lower end of said shaft portion being about 25mm, and said frame portion has in said direction a maximum thickness (T3) at side portions thereof which are located on opposite sides of a striking sweet spot at the same distance from said upper end of said shaft portion and a minimum thickness (T4) at the top thereof, said maximum thickness (T3) being about 30mm and said minimum thickness (T4) being about 21mm, whereby a time elapsed until said shaft portion reaches an initial maximum amplitude value when vibrating in the ball striking direction at an impact of a ball is in the range of 90% to 110% of a time elapsed until said side portions of said frame portion reach an initial maximum amplitude value when vibrating toward the center of said striking area at the impact.

4. A tennis racket as claimed in claim 3, wherein the thickness (t) of said frame portion in a direction parallel to said striking area is substantially constant throughout the whole circumference thereof.

* * * * *